US007464442B2

(12) United States Patent
Laporte

(10) Patent No.: US 7,464,442 B2
(45) Date of Patent: Dec. 16, 2008

(54) BUNDLING TIE

(75) Inventor: Richard Laporte, Collierville, TN (US)

(73) Assignee: Thomas & Betts International, Inc., Wilmington, DE (US)

( * ) Notice: Subject to any disclaimer, the term of this patent is extended or adjusted under 35 U.S.C. 154(b) by 226 days.

(21) Appl. No.: 11/315,425

(22) Filed: Dec. 21, 2005

(65) Prior Publication Data

US 2006/0213034 A1 Sep. 28, 2006

Related U.S. Application Data

(60) Provisional application No. 60/665,907, filed on Mar. 28, 2005.

(51) Int. Cl.
*B65D 63/02* (2006.01)

(52) U.S. Cl. ..... 24/20 R

(58) Field of Classification Search ..... 24/20 R, 24/20 CW, 20 EE, 20 TT, 20 W
See application file for complete search history.

(56) References Cited

U.S. PATENT DOCUMENTS

| | | | | | |
|---|---|---|---|---|---|
| 156,263 | A | | 10/1874 | Terrell | |
| 201,431 | A | | 3/1878 | Logue | |
| 1,084,407 | A | * | 1/1914 | Deist | 40/304 |
| 1,099,460 | A | | 6/1914 | McFarland | |
| 1,190,667 | A | | 7/1916 | O'Riordan | |
| 1,411,930 | A | | 4/1922 | Peterson | |
| 2,034,636 | A | | 3/1936 | Sides | |
| 2,218,717 | A | | 10/1940 | McKee | |
| 2,291,773 | A | | 8/1942 | Taylor | |
| 2,336,139 | A | | 12/1943 | Vogel | |
| 3,102,311 | A | | 9/1963 | Martin et al. | |
| 3,186,047 | A | | 6/1965 | Schwester et al. | |
| 3,216,079 | A | | 11/1965 | Keyworth | |
| D205,940 | S | | 10/1966 | Miller | |
| 3,526,022 | A | | 9/1970 | Ichikawa | |
| 4,152,475 | A | | 5/1979 | Haley | |
| 4,411,049 | A | | 10/1983 | Cristea | |
| 4,541,146 | A | | 9/1985 | Giannone | |
| 4,765,032 | A | | 8/1988 | Fortsch | |
| 4,868,953 | A | | 9/1989 | Fortsch | |
| 4,896,402 | A | * | 1/1990 | Jansen et al. | 24/20 R |
| 4,902,997 | A | | 2/1990 | Moran | |
| 5,047,100 | A | | 9/1991 | Raymond | |
| 5,198,137 | A | | 3/1993 | Rutz et al. | |
| 5,395,695 | A | | 3/1995 | Shain et al. | |
| 5,472,661 | A | | 12/1995 | Gay | |
| 5,621,949 | A | | 4/1997 | Wells et al. | |
| 5,629,092 | A | | 5/1997 | Gay et al. | |

(Continued)

*Primary Examiner*—James R Brittain
(74) *Attorney, Agent, or Firm*—Hoffman & Baron, LLP

(57) ABSTRACT

A tie provides for the bundling of one or more articles. A deformable tie has an elongate strap including an elongate tail at one end and a locking head at the other end. The locking head includes a pair of holding tabs defining a passageway therethrough and slot spaced from the holding tabs having a raised wall. The tie is placed about the articles to be bundled. The tail is inserted through the passageway of the holding tabs in a first direction. The tail is then passed through the slot in the first direction. The tail is bent around the raised slot wall so as to extend in a second direction opposite the first direction. The tail is then passed through the passageway of the holding tab in the second direction and the tail is bent around the holding tab so as to extend back in the first direction.

19 Claims, 4 Drawing Sheets

U.S. PATENT DOCUMENTS

| | | | |
|---|---|---|---|
| 5,630,252 | A | 5/1997 | Wells |
| 5,679,402 | A | 10/1997 | Lee |
| 5,690,522 | A | 11/1997 | Moreau |
| 6,044,525 | A | 4/2000 | Sastre et al. |
| 6,076,235 | A | 6/2000 | Khokhar |
| 6,128,809 | A | 10/2000 | Khokhar |
| 6,185,791 | B1 | 2/2001 | Khokhar |
| 6,663,809 | B1 | 12/2003 | Haddock et al. |
| 6,816,794 | B2 | 11/2004 | Alvi |
| 7,017,237 | B2 | 3/2006 | Magno, Jr. et al. |

* cited by examiner

BUNDLING TIE

CROSS-REFERENCE TO RELATED APPLICATIONS

This application claims the benefit of U.S. Provisional Application No. 60/665,907 filed on Mar. 28, 2005, entitled "Method For Securing A Bundling Tie About An Article".

FIELD OF THE INVENTION

The present invention relates generally to a tie for bundling one or more articles. More particularly the present invention relates to a stainless steel bundling tie which may be secured around the articles.

BACKGROUND OF THE INVENTION

The art has seen the use of bundling or cable ties for securing one or more articles. These ties may be formed of a wide variety of materials based on the particular application.

In certain industrial applications, due to a particular environment where a tie used, the tie must be formed of material capable of withstanding adverse conditions. Such conditions are found, for example, in marine and chemical plant environments.

The art has seen the use of stainless steel ties which allow a plurality of articles such as wires and cables to be bundled together. By virtue of the material forming the tie, the stainless steel tie is able to withstand these adverse environment. One example of a stainless steel cable tie useful in adverse environments is shown in U.S. Pat. No. 4,765,032 to Fortsch.

While these stainless steel ties serve adequately in withstanding the adverse environments encountered, many of the stainless steel ties require specialized tools to adequately secure the tie around the articles. Once secured with a tool, these ties are ordinarily not reusable. In situations where tools are not employed, the tie may not exhibit the requisite tensile strength necessary to maintain a secure engagement around the bundle.

It is, therefore, desirable to provide a bundling tie formed of stainless steel which can be securely maintained around a bundle of articles such as wires and cables without the need for using tools to effect such securement and which exhibits the requisite tensile strength.

SUMMARY OF THE INVENTION

The present invention provides a method for bundling an article or a plurality of articles using a tie. The method includes providing a deformable tie having an elongate strap including an elongate tail at one end and a locking head at the other end. The locking head includes a pair of holding tabs defining a passage therethrough and a slot spaced from the holding tabs having a raised wall. The tie is placed about the article to be bundled. The tail is inserted through the passage of the holding tabs in the first direction. The tail is then passed through the slot in the first direction. The tail is bent about the raised slot wall so as to extend in a second direction opposite the first direction. The tie is then passed through the passage of the holding tab in the second direction. The tie is then bent around the holding tab so as to extend back in the first direction.

In a preferred embodiment of the present invention, the tie is formed of a plastically deformable metal, more preferably stainless steel.

DETAILED DESCRIPTION OF THE PREFERRED EMBODIMENTS

Figure 6:
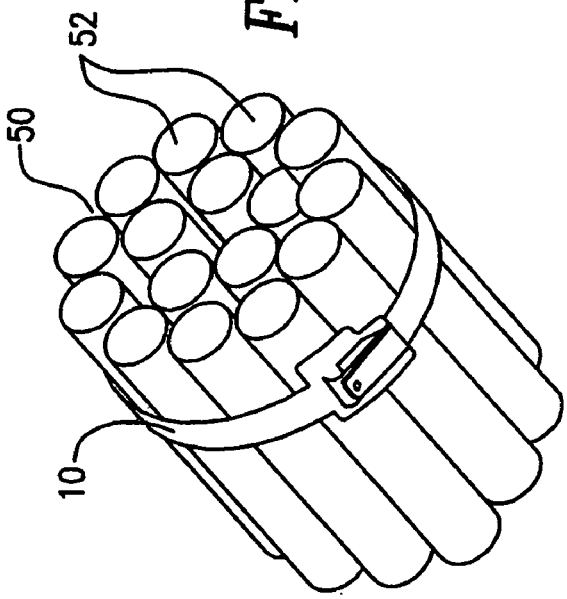
FIG. 6 shows the cable tie installed in accordance with the present invention around the bundle of articles.

Referring to the figures, the present invention provides a cable tie 10 which may be secured around a bundle 50 of articles 52 (FIG. 6). As used here and throughout, the term "cable tie" refers to a bundling strap or tie, having a tail at one end and a locking head at the other end. The articles 50 may include one or more electrical cables or any other elongate elements that are bundled together where there is a desire to secure the bundle of articles.

Referring now to FIGS. 1 through 6, the tie employed in the method of the present invention is shown.

The tie 10 is an elongate member similar to those of conventional construction. Tie 10 includes an elongate strap body 12 having an elongate tail 14 at one end and a locking head 16 at the opposite end. In the present illustrative embodiment, the tie 10 is formed of a deformable material. Preferably, the tie is formed of a material which may be plastically deformed such that once deformed the material will maintain its deformed shape. More specifically, in the present embodiment, the tie is formed of stainless steel.

The present invention provides a novel method of securing the tail to the head without use of tools and which provides the requisite tensile strength necessary to retain the bundled articles.

The tie 10 may be wrapped around a plurality of articles 52 and then the tail 14 is inserted into the head 16 to provide secure locking engagement thereto. The tail 14 of the present invention has a tapered or rounded distal extent 14*a* which facilitates insertion thereof into the head as will be described in further detail hereinbelow.

Head 16 includes at a distal end thereof, a pair of inwardly facing tabs 18 which are raised from the plane of the head so as to define an insertion passageway 20. It is also contemplated that the tabs 18 may define a continuous joined tab defining passageway 20. Spaced from passageway 20, the head 16 also includes a wall 22 raised from the plane of the head which defines a slot 24 therethrough.

It is contemplated that the head 16 of cable tie 10 may be manufactured in a flat configuration and the tabs 18 as well as the slot wall 22 can be struck outwardly therefrom. Such manufacturing results in both the passageway 20 and the slot 24 being on the same plane so as to accommodate the insertion of the tail 14 therethrough.

Figures 1, 2, 3, 4, 5:
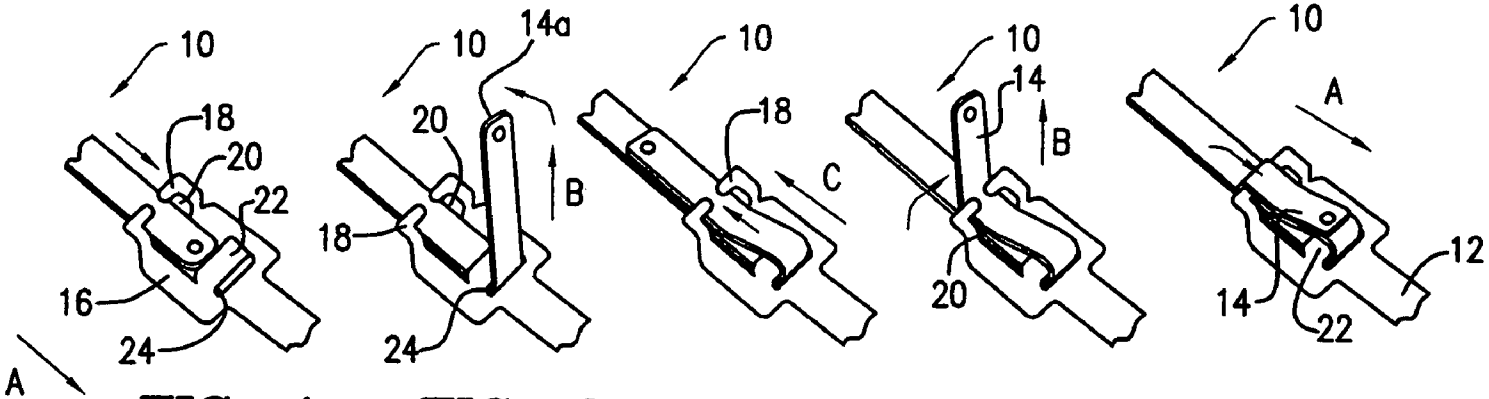
FIGS. 1-5 show the successive steps of the present invention where a deformable cable tie is secured around a bundle.

With reference to FIGS. 1-5, the successive steps of securing a tie around the plurality of articles 52 may be described. Tie 10 is wrapped around articles 52 in conventional fashion. The tail 14 is then inserted through the passageway 20 so that it extends in a direction indicated by arrow A. The tail 14 is further advanced in the direction of arrow A so that the tail extends through slot 24. The tail is pulled in the direction of arrow A until sufficient tension is maintained around the bundle 50. Thereafter, as shown in FIG. 2, the tail is bent upwardly at a 90° angle to extend in a direction of arrow B. Slot wall 22 provides leverage for such bending while maintaining tension around the bundle 50. As the stainless steel material is plastically deformable, such bending will maintain tension of the tie 10 around the bundle 50. Thereafter, the tail 14 is bent downwardly so as to extend in the direction of arrow C which is opposite the direction of arrow A. In this regard, and referring to FIG. 3, the tail is inserted back through passageway 20 so that the tail 14 overlies strap body 12. In the position shown in FIG. 3, the tail is essentially folded back over itself. The space between the holding tabs, in the preferred embodiment, aids in reinsertion of the tail 14 into passageway 20.

Referring to FIG. 4, the tail 14 is bent upwardly to extend in the direction of arrow B. The tabs 18 provide leverage so as to maintain tension around the bundle. Thereafter, as shown in FIG. 5, the tail is again folded downwardly so that it extends in a direction of arrow A, the original insertion direction.

In making each of these bends, it is desirable to make the bends as sharp as possible so as to maintain adequate tension on the bundle.

The present invention thus contemplates double folding the tail about the head, forming two separate bends each at 180°. Such double folding maintains the tensile strength of the tie around the bundle without the need for a tool to permanently crimp the tail to the head. Moreover, as the securement of the tail to the head is by virtue of deforming the tie, the tie may be released by reversing the steps shown in FIGS. 1-5. This results in the tie being reuseable.

Figure 7:
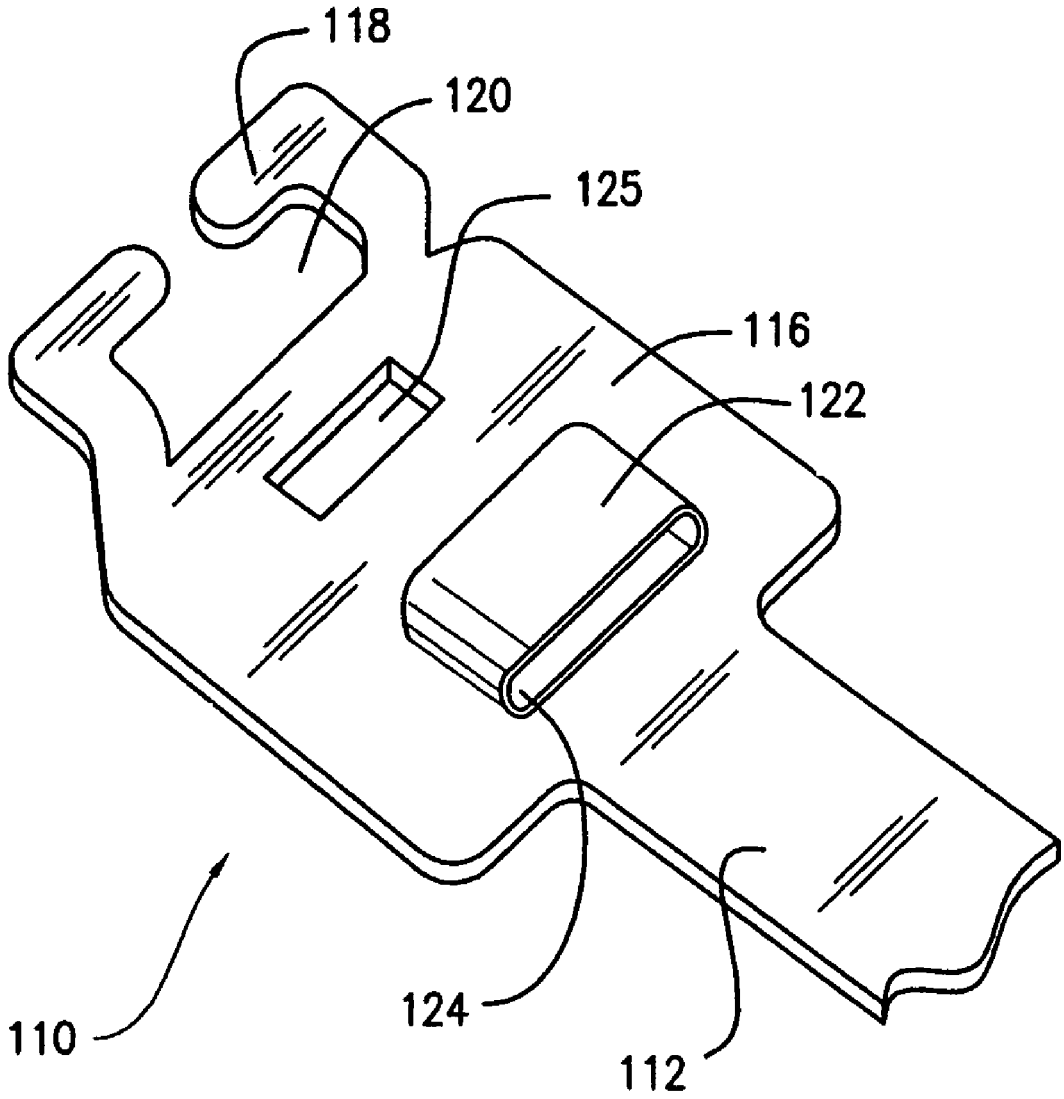
FIGS. 7 and 8 show a cable tie installed in accordance with an alternate embodiment of the present invention.
Figure 8:
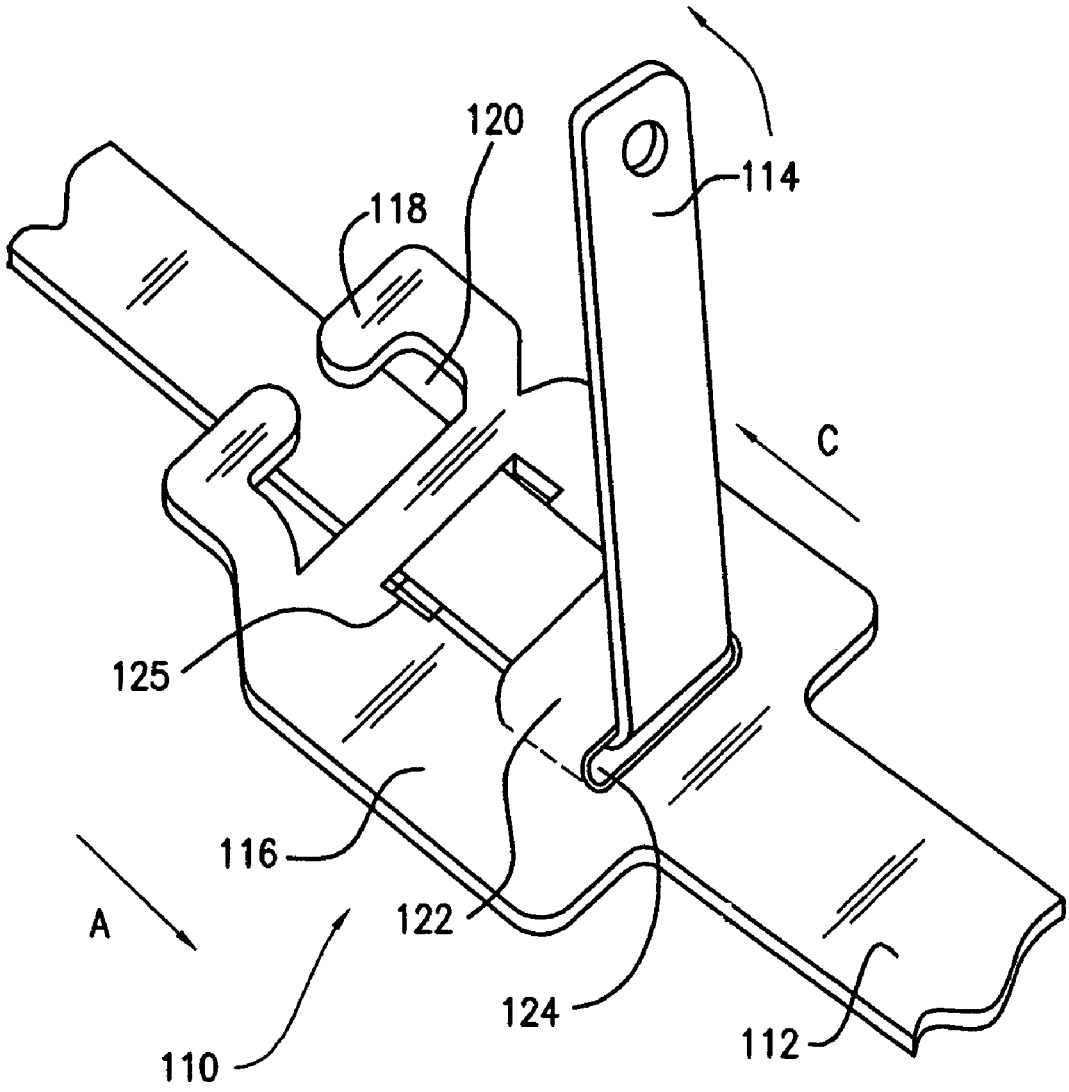

Turning now to FIGS. 7 and 8, an alterative arrangement for securing a cable tie around a bundle of articles is shown. Cable tie 110 is substantially similar to cable tie 10 described above. Cable tie 110 includes a head 116, a tail 114, and an elongate strap body 112 therebetween. The head 116 includes, at a distal end thereof, a pair of inwardly facing tabs 118 which are raised from the plane of the head so as to define insertion passageway 120. Spaced from passageway 120, the head 116 includes a wall 122 raised from the plane of the head which defines a slot 124 therethrough.

In addition, in the embodiments shown in FIGS. 7 and 8, locking head 16 includes a central aperture 125 located in intermediate passageway 120 in slot 124. As will be described in further detail hereinbelow, aperture 125 is used additionally for securement of the tail 114 in head 116.

Referring now specifically to FIG. 8, the tail 114 is inserted into head 116 in the following manner. The tail is inserted through central aperture 125 in the direction of arrow A. The tail 114 is then extended in the same direction through slot 124. The tail would then be bent around wall 122 and back onto itself in a manner similar to that described above so as to extend in a direction of arrow C which is opposite arrow A. The tail 114 is then advanced in the direction of arrow A so as to extend back through passageway 120 so that the tail lies over itself in the direction of arrow C. Thereafter, the tail can be bent upwardly using tabs 118 as leverage so that it extends at an angle 90° therefrom. Subsequently, the tail can be bent further so as to extend again in the direction of arrow A or the upwardly tail could be severed at tabs 118.

Figure 9:
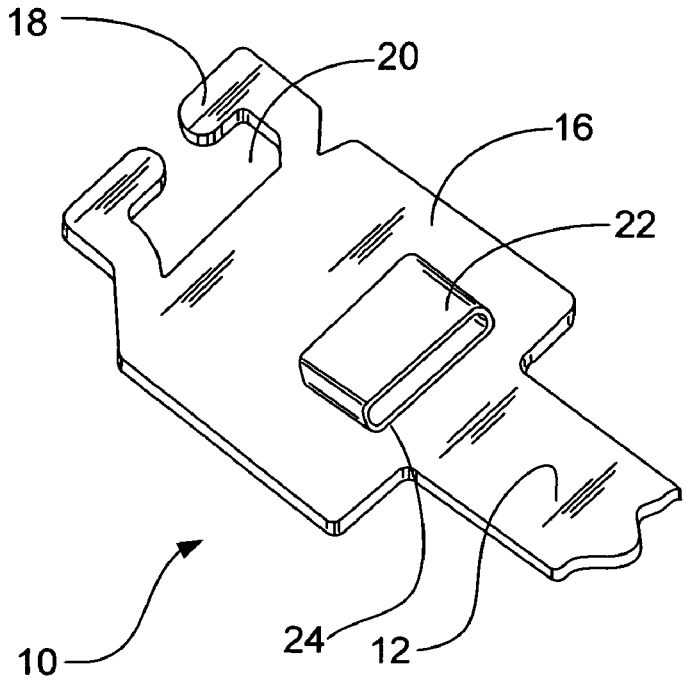
FIG. 9 shows the locking head of the cable tie shown in FIGS. 1-5.

FIG. 9 shows the locking head 16 end of the cable tie 10 shown in FIGS. 1-5. The elongate strap body 12 connects to one end of the locking head 16 and the second end of the locking head 16 has a pair of tabs 18 extending therefrom to define a passageway. The locking head 16 also includes a wall 22 raised from the surface of the locking head 16 to define a slot 24.

Figure 10:
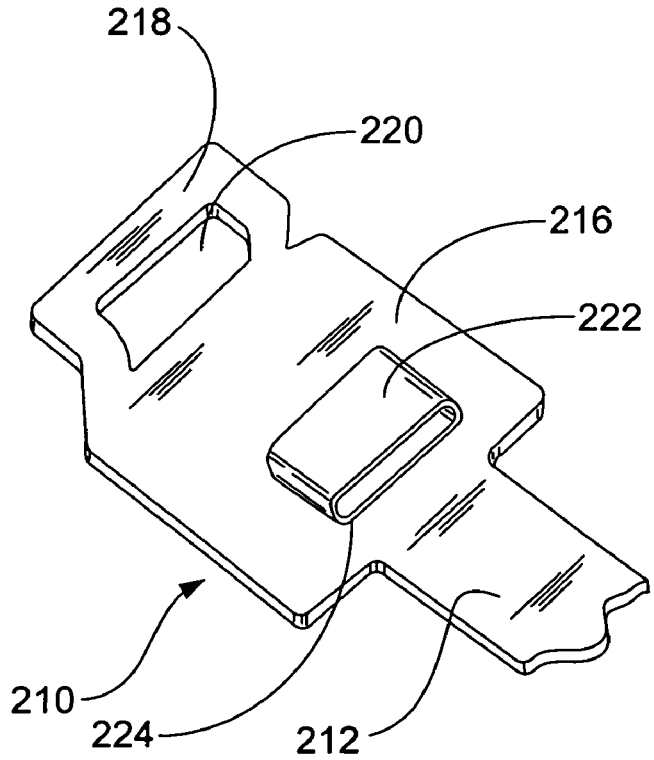
FIG. 10 shows an alternate embodiment of the locking head shown in FIG. 9 with the tabs connected to form a continuous wall.

FIG. 10 shows an embodiment of the cable tie 210 in which the locking head 216 is connected to the strap body 212 at one end and the opposing end has a pair of tabs 218 that join together to form a passageway 220. The locking head 216 also includes a wall 222 raised from the surface of the locking head 216 to define a slot 224.

Various changes to the foregoing described and shown structures would now be evident to those skilled in the art. Accordingly, the particularly disclosed scope of the invention is set forth in the following claims.

What is claimed is:

1. A bundling tie comprising:

an elongate strap comprising a deformable tail and tail tip at the end thereof;

a locking head having a first end, a second end and a surface, wherein said first end is secured to an opposite end of said elongate strap;

a first tail passageway for the passage of said deformable tail therethrough formed in said locking head and comprising a first tail passage wall, wherein the first tail passage wall is formed by a pair of tabs, wherein each tab has a first section and a second section, wherein each first section extends from said second end of said locking head in a direction opposite the first end of the locking head and connects to said second section, and wherein said second sections extend inwardly towards each other to define said first tail passageway;

a second tail passageway for the passage of said deformable tail therethrough formed in said locking head and comprising a second tail passage wall, wherein said second tail passage wall has opposing ends, wherein each of said opposing ends is connected to said surface of said locking head, and wherein the second tail passage wall is continuous and raised from the locking head to define a slot;

a first bend in said deformable tail about said second tail passage wall after said deformable tail passes through at least said second tail passageway; and a second bend in said deformable tail intermediate said first bend and said tip, said second bend extending about said first tail passage wall without breaking thereby forming two bends in said deformable tail.

2. A bundling tie as set forth in claim 1 wherein said first and second tail passageways being generally in alignment with each other.

3. A bundling tie as set forth in claim 1 wherein said first and second tail passage walls are offset from said surface of said locking head.

4. A bundling tie as set forth in claim 1 wherein said bundling tie is formed of stainless steel.

5. A bundling tie as set forth in claim 1 wherein said deformable tail has a tapered distal end.

6. A bundling tie as set forth in claim 1 wherein said first bend is formed in said deformable tail after said tail passes through both said first and second passageways.

7. A bundling tie as set forth in claim 1 wherein said first bend is approximately 180 degrees and said second bend is in excess of about 90 degrees whereby said deformable tail forms two bends of 90 degrees or more.

8. A bundling tie as set forth in claim 1 further comprising a third tail passageway for the passage of said deformable tail therethrough formed in said locking head intermediate said first and second tail passageways.

9. A bundling tie as set forth in claim 8 wherein said tail tip sequentially passes through said third tail passageway, said second tail passageway and then said first tail passageway.

10. A bundling tie comprising:

an elongate strap comprising a deformable tail and tail tip at the end thereof;

a locking head secured to an opposite end of said elongate strap;

a first tail passageway for the passage of said deformable tail therethrough formed in said locking head and comprising a first tail passage wall;

a second tail passageway for the passage of said deformable tail therethrough formed in said locking head and comprising a second tail passage wall;

a third tail passageway for the passage of said deformable tail therethrough formed in said locking head intermediate said first and second tail passageways;

a first bend in said deformable tail about an edge surface of said third tail passageway; and a second bend in said deformable tail intermediate said first bend and said tail tip, said second bend being about said second tail passage wall.

11. A bundling tie as set forth in claim 10 wherein said second bend is approximately 180 degrees and said deformable tail further passes through said first tail passageway.

12. A bundling tie as set forth in claim 11 wherein said deformable tail is further bent in excess of 90 degrees about said first tail passage wall.

13. A bundling tie comprising:

an elongate strap having opposing ends;

a tail on one end of the strap; and a locking head on the other end of the strap, wherein the locking head comprises:

a body having a top surface;

a first end connecting the body to the elongate strap;

a second end having a pair of tabs, wherein each tab has a first section and a second section, wherein each first section extends from said second end of said locking head in a direction opposite the first end and connects to said second section, and wherein said second sections extend inwardly towards each other to define a passageway; and a raised wall located between the first and second ends of the body and having opposing ends connected to the top surface of the body and raised from the top surface of the body to define a slot;

wherein the tail end is adapted to sequentially pass through the passageway, the slot and the passageway.

14. The bundling tie as set forth in claim 13, wherein the second section of each of the tabs is disposed substantially perpendicular to the first section.

15. The bundling tie as set forth in claim 14, wherein the two second sections of the tabs join together to form a continuous joined tab.

16. The bundling tie as set forth in claim 13, wherein the tabs extend upwardly from the top surface.

17. The bundling tie as set forth in claim 13, wherein the passageway and the slot are generally in alignment with each other.

18. A bundling tie comprising:

an elongate strap having opposing ends;

a tail on one end of the strap; and a locking head on the opposing end of the strap, wherein the locking head comprises:

a body having a top surface;

a first end connecting the body to the elongate strap;

a second end having a passageway;

a raised wall located between the first and second ends and having opposing ends connected to the top surface of the body to define a slot; and an aperture in the body intermediate the second end and the raised wall, wherein the tail end is adapted to sequentially pass through the aperture, the slot and the passageway.

19. The bundling tie as set forth in claim 18, wherein the passageway is defined by a pair of tabs extending away from the first end and facing inwardly or a continuous wall.

* * * * *